US012379170B2

(12) United States Patent
Segraves

(10) Patent No.: US 12,379,170 B2
(45) Date of Patent: Aug. 5, 2025

(54) MANUAL BOLT ASSEMBLY FOR A FIREARM

(71) Applicant: Molon Labe LLC, Corning, AR (US)

(72) Inventor: Jeffery Allen Segraves, Maynard, AR (US)

(73) Assignee: Molon Labe LLC, Corning, AR (US)

( * ) Notice: Subject to any disclaimer, the term of this patent is extended or adjusted under 35 U.S.C. 154(b) by 0 days.

(21) Appl. No.: 18/621,727

(22) Filed: Mar. 29, 2024

(65) Prior Publication Data

US 2024/0328735 A1 Oct. 3, 2024

Related U.S. Application Data

(60) Provisional application No. 63/455,830, filed on Mar. 30, 2023.

(51) Int. Cl.
*F41A 3/72* (2006.01)
*F41A 3/66* (2006.01)

(52) U.S. Cl.
CPC . *F41A 3/72* (2013.01); *F41A 3/66* (2013.01)

(58) Field of Classification Search
CPC ..... F41A 3/18; F41A 3/22; F41A 3/20; F41A 3/72; F41A 3/66; F41A 3/42
USPC ..... 89/1.4; 42/16
See application file for complete search history.

(56) References Cited

U.S. PATENT DOCUMENTS

| | | | | |
|---|---|---|---|---|
| 10,006,726 | B1 * | 6/2018 | Oglesby | F41A 3/20 |
| 10,578,379 | B2 * | 3/2020 | DeSomma | F41A 3/72 |
| 10,627,177 | B2 * | 4/2020 | Hamilton | F41A 9/59 |
| 2011/0061523 | A1 * | 3/2011 | Webb | F41A 3/42 89/128 |
| 2024/0318933 | A1 * | 9/2024 | Parker | F41A 35/06 |

* cited by examiner

*Primary Examiner* — Reginald S Tillman, Jr.
(74) *Attorney, Agent, or Firm* — EVERSHEDS SUTHERLAND (US) LLP

(57) ABSTRACT

A manual bolt assembly for a firearm may include a bolt carrier, a bolt, a cam lock, and a bolt handle. The bolt carrier may include a first central passage extending from a proximal end to a distal end of the bolt carrier, and a cutout defined along a side of the bolt carrier. The bolt may extend through the first central passage and may include a second central passage extending from a proximal end of the bolt, and a first aperture extending through a wall of the bolt to the second central passage. The cam lock may engage the bolt carrier and may include an arm movably disposed within the cutout, a third central passage extending from a proximal end of the cam lock, and a second aperture extending through a wall of the cam lock to the third central passage. The bolt handle may be coupled to the cam lock and may include a lever extending away from the cam lock, and a protrusion extending through the second aperture and through the first aperture.

20 Claims, 16 Drawing Sheets

MANUAL BOLT ASSEMBLY FOR A FIREARM

CROSS-REFERENCE TO RELATED APPLICATIONS

The present application claims the benefit of and priority to U.S. Provisional Application No. 63/455,830, filed on Mar. 30, 2023, the disclosure of which is incorporated by reference herein in its entirety.

FIELD OF THE DISCLOSURE

The present disclosure relates generally to firearms and, more particularly, to a manual bolt assembly for an AR pattern rifle for changing the action of the rifle from semi-automatic to manual bolt action.

BACKGROUND OF THE DISCLOSURE

Certain firearms, such as AR pattern rifles, generally may be configured for semi-automatic operation and may lack means for manually actuating the bolt of the firearm. In some circumstances, it may be desirable to have an option to manually actuate the bolt of such firearms. For example, in some instances, manual actuation of the bolt may allow an operator to be more accurate when shooting the firearm. In other instances, firearm regulations in some jurisdictions may prohibit semi-automatic operation of certain firearms, thereby preventing use of such firearms without means for manually actuating the bolt of the firearm.

A need therefore remains for improved bolt assemblies for firearms and related methods of manufacturing and using the same, which may overcome one or more of the foregoing drawbacks associated with existing bolt assemblies and firearms.

SUMMARY OF THE DISCLOSURE

The present disclosure provides manual bolt assemblies for a firearm, assemblies for a firearm, and related methods of manufacturing and using such manual bolt assemblies and assemblies.

In one aspect, a manual bolt assembly for a firearm is provided. According to one example, the manual bolt assembly may include a bolt carrier, a bolt, a cam lock, and a bolt handle. The bolt carrier may include a first central passage extending from a proximal end to a distal end of the bolt carrier, and a cutout defined along a side of the bolt carrier. The bolt may extend through the first central passage and may include a second central passage extending from a proximal end of the bolt, and a first aperture extending through a wall of the bolt to the second central passage. The cam lock may engage the bolt carrier and may include an arm movably disposed within the cutout, a third central passage extending from a proximal end of the cam lock, and a second aperture extending through a wall of the cam lock to the third central passage. The bolt handle may be coupled to the cam lock and may include a lever extending away from the cam lock, and a protrusion extending through the second aperture and through the first aperture.

In some examples, the cam lock and the bolt may be configured to rotate relative to bolt carrier upon rotation of the bolt handle relative to the bolt carrier. In some examples, the arm of the cam lock may be configured to move within the cutout of the bolt carrier when the cam lock rotates relative to the bolt carrier. In some examples, the cam lock may be configured to translate rearward relative to the bolt carrier when the cam lock rotates relative to the bolt carrier. In some examples, the bolt carrier may include a cam ramp disposed adjacent to the cutout and configured to cause the cam lock to translate rearward relative to the bolt carrier when the cam lock rotates relative to the bolt carrier. In some examples, the first aperture may include an elongated slot configured such that the bolt does not translate relative to the bolt carrier when the cam lock translates rearward relative to the bolt carrier. In some examples, the cam lock may be configured to translate rearward relative to the bolt carrier from a first position to a second position, and the protrusion of the bolt handle may be configured to allow a firing pin of the firearm to translate forward toward the bolt when the cam lock is in the first position and to block the firing pin from translating forward toward the bolt when the cam lock is in the second position. In some examples, the cam lock may be configured to rotate relative to the bolt carrier from a first rotational position to a second rotational position, the bolt carrier may include a notch disposed adjacent the cutout, and the cam lock may include a protrusion configured to engage the notch when the cam lock is in the first position and to disengage the notch as the cam lock rotates from the first position to the second position. In some examples, the bolt may include a pair of first planar surfaces, and the cam lock may include a pair of second planar surfaces engaging the first planar surfaces such that the bolt rotates with the cam lock upon rotation of the bolt handle relative to the bolt carrier. In some examples, the bolt handle may be removably coupled to the cam lock by a fastener extending through the bolt handle and engaging a bore of the cam lock.

In another aspect, an assembly for a firearm is provided. According to one example, the assembly may include an upper receiver and a manual bolt assembly. The upper receiver may include a slot defined in a lateral side of the upper receiver. The manual bolt assembly may include a bolt carrier, a bolt, a cam lock, and a bolt handle. The bolt carrier may include a first central passage extending from a proximal end to a distal end of the bolt carrier, and a cutout defined along a side of the bolt carrier. The bolt may extend through the first central passage and may include a second central passage extending from a proximal end of the bolt, and a first aperture extending through a wall of the bolt to the second central passage. The cam lock may engage the bolt carrier and may include an arm movably disposed within the cutout, a third central passage extending from a proximal end of the cam lock, and a second aperture extending through a wall of the cam lock to the third central passage. The bolt handle may be coupled to the cam lock, may extend through the slot of the upper receiver, and may include a lever extending away from the cam lock, and a protrusion extending through the second aperture and through the first aperture.

In some examples, the cam lock and the bolt may be configured to rotate relative to bolt carrier upon rotation of the bolt handle relative to the bolt carrier. In some examples, the arm of the cam lock may be configured to move within the cutout of the bolt carrier when the cam lock rotates relative to the bolt carrier. In some examples, the cam lock may be configured to translate rearward relative to the bolt carrier when the cam lock rotates relative to the bolt carrier. In some examples, the bolt carrier may include a cam ramp disposed adjacent to the cutout and configured to cause the cam lock to translate rearward relative to the bolt carrier when the cam lock rotates relative to the bolt carrier. In some examples, the first aperture may include an elongated slot configured such that the bolt does not translate relative to the bolt carrier when the cam lock translates rearward relative to the bolt carrier. In some examples, the cam lock may be configured to translate rearward relative to the bolt carrier from a first position to a second position, and the protrusion of the bolt handle may be configured to allow a firing pin of the firearm to translate forward toward the bolt when the cam lock is in the first position and to block the firing pin from translating forward toward the bolt when the cam lock is in the second position. In some examples, the cam lock may be configured to rotate relative to the bolt carrier from a first rotational position to a second rotational position, the bolt carrier may include a notch disposed adjacent the cutout, and the cam lock may include a protrusion configured to engage the notch when the cam lock is in the first position and to disengage the notch as the cam lock rotates from the first position to the second position. In some examples, the bolt may include a pair of first planar surfaces, and the cam lock may include a pair of second planar surfaces engaging the first planar surfaces such that the bolt rotates with the cam lock upon rotation of the bolt handle relative to the bolt carrier. In some examples, the bolt handle may be removably coupled to the cam lock by a fastener extending through the bolt handle and engaging a bore of the cam lock.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

DETAILED DESCRIPTION OF THE DISCLOSURE

Figure 1B:
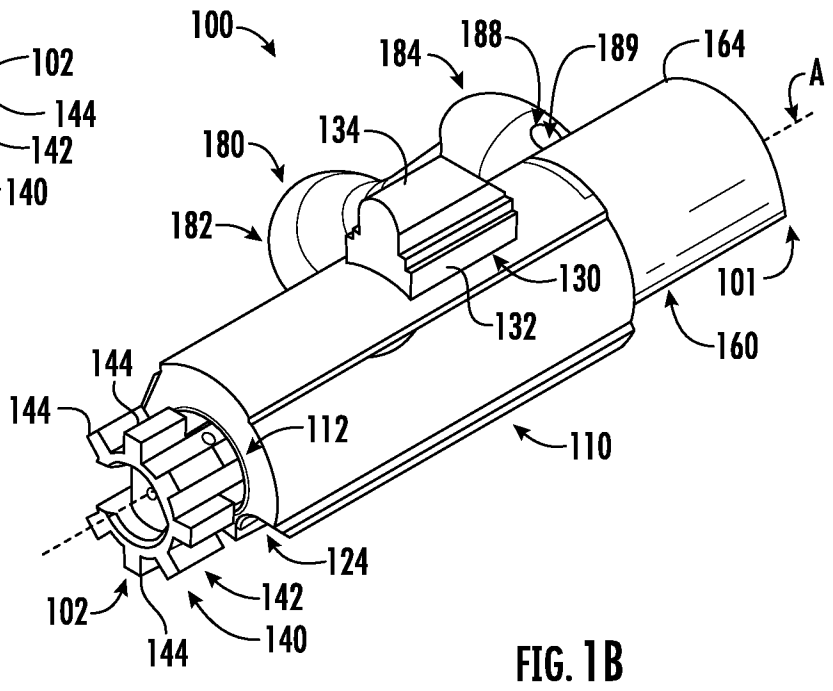
FIG. 1B is another perspective view of the manual bolt assembly of FIG. 1A.
Figure 1A:
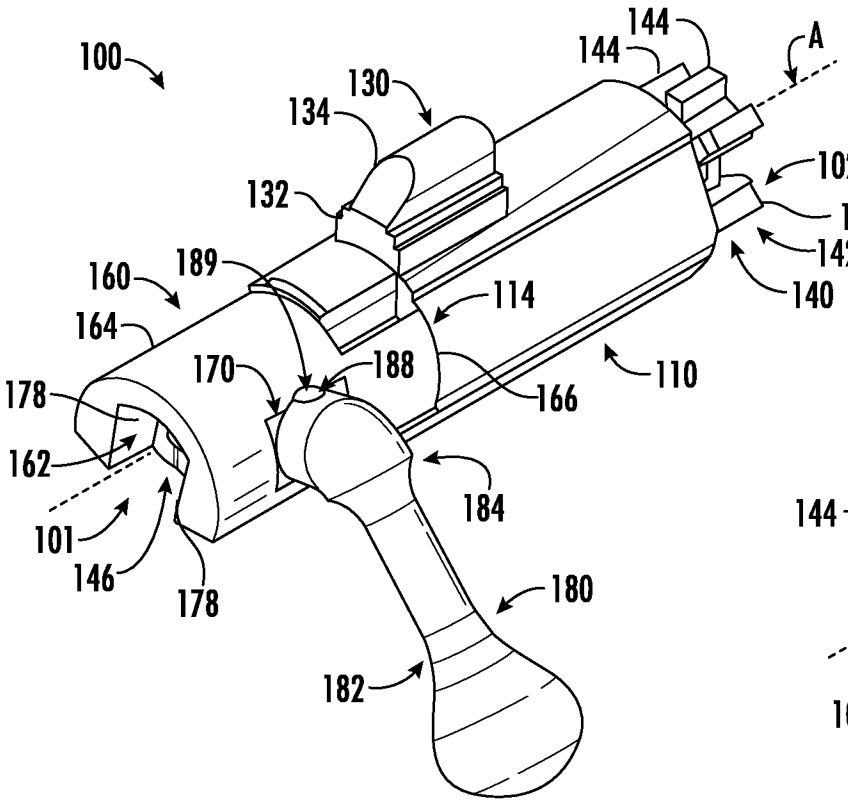
FIG. 1A is a perspective view of a manual bolt assembly for a firearm, according to one or more examples of the disclosure, showing a bolt carrier, a gas key, a bolt, a cam lock, and a bolt handle of the manual bolt assembly.
Figure 1D:
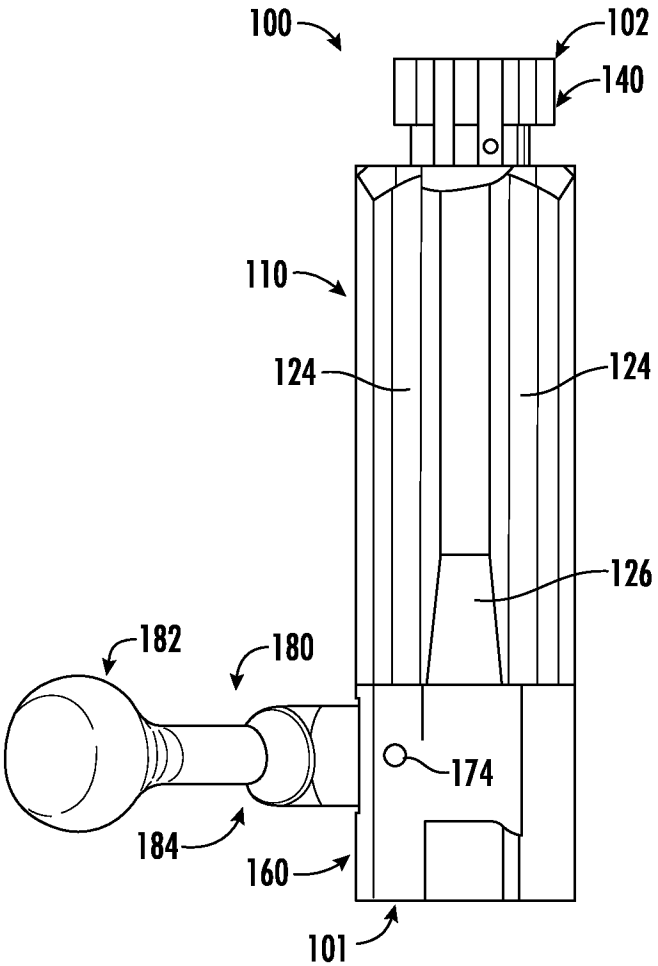
FIG. 1D is a bottom view of the manual bolt assembly of FIG. 1A.
Figure 1C:
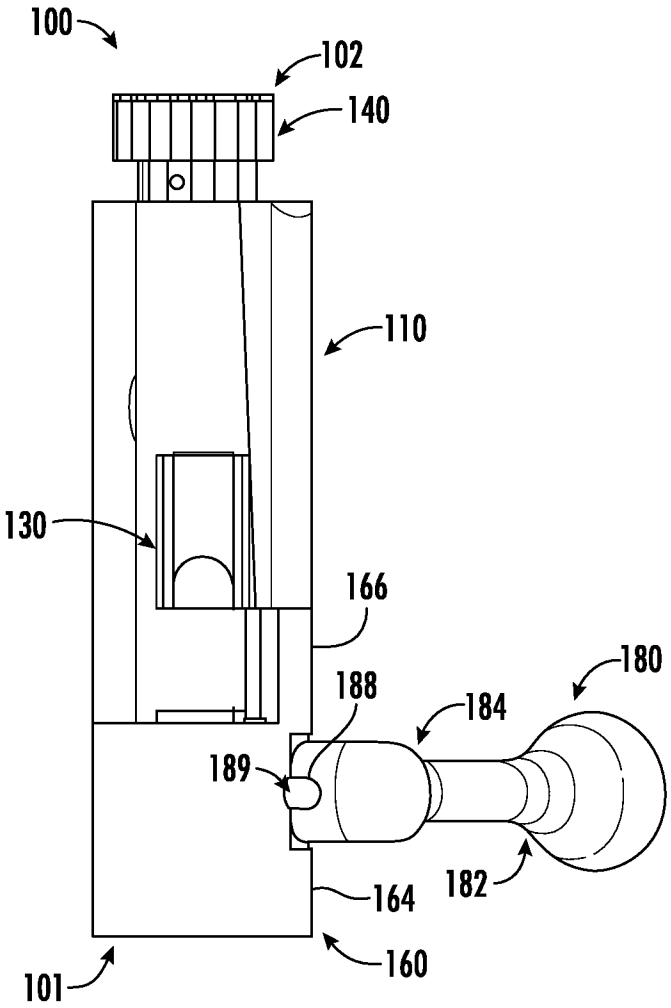
FIG. 1C is a top view of the manual bolt assembly of FIG. 1A.
Figure 1E:
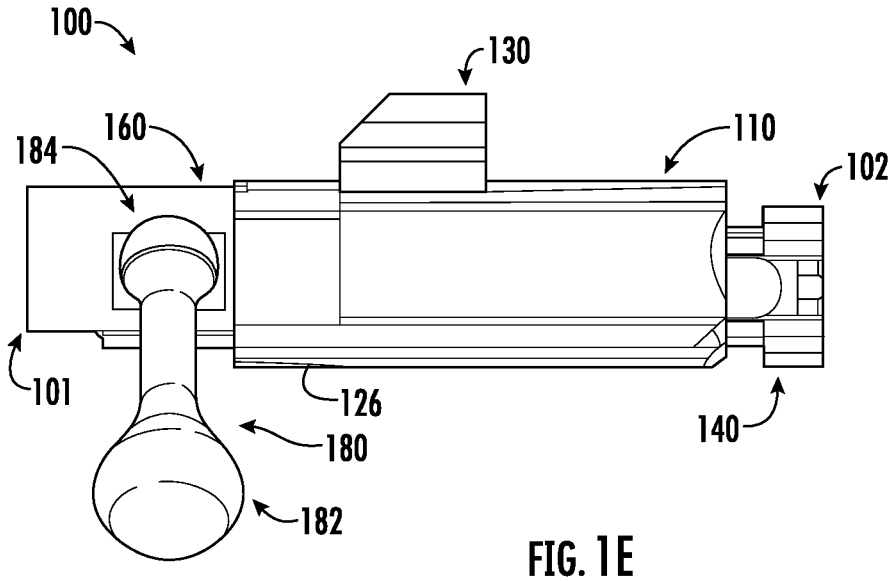
FIG. 1E is a right side view of the manual bolt assembly of FIG. 1A.
Figure 1F:
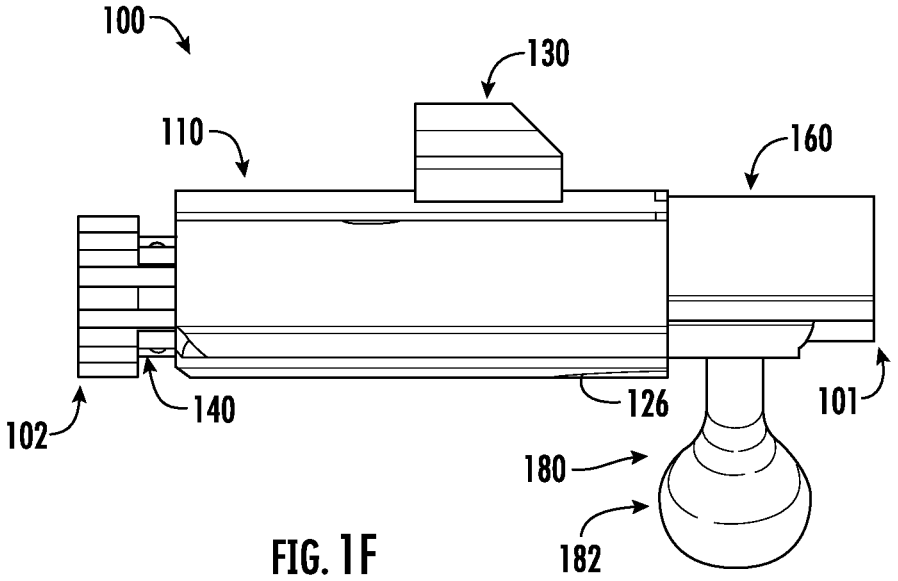
FIG. 1F is a left side view of the manual bolt assembly of FIG. 1A.
Figure 1H:
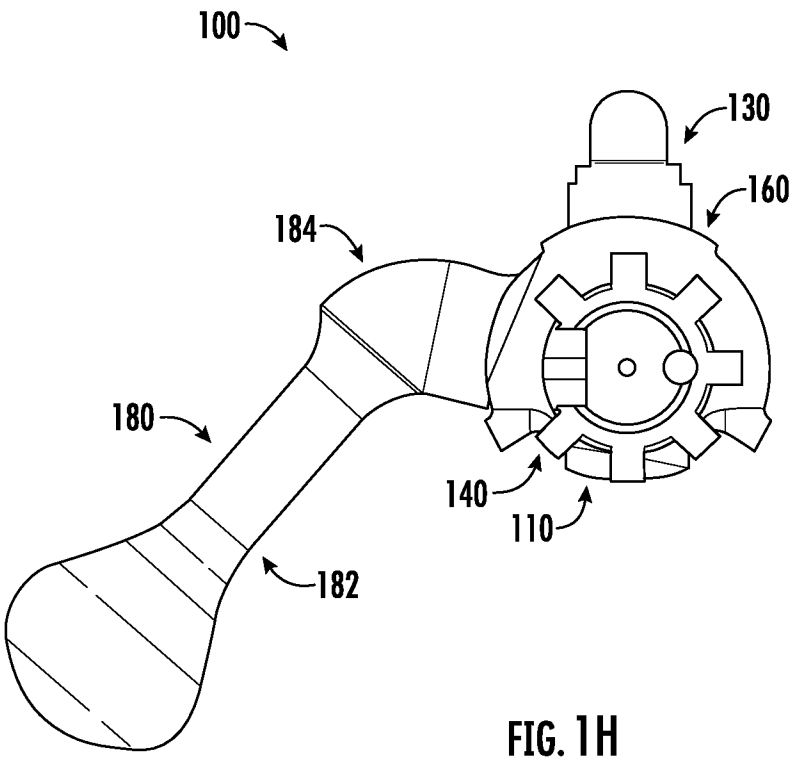
FIG. 1H is a distal end view of the manual bolt assembly of FIG. 1A.
Figure 1G:
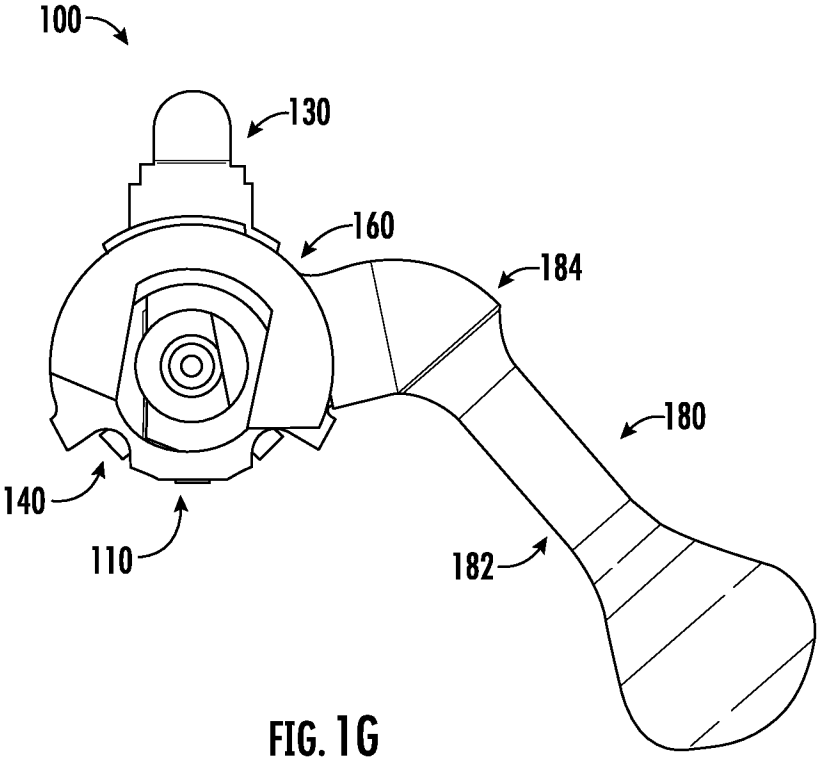
FIG. 1G is a proximal end view of the manual bolt assembly of FIG. 1A.
Figure 1I:
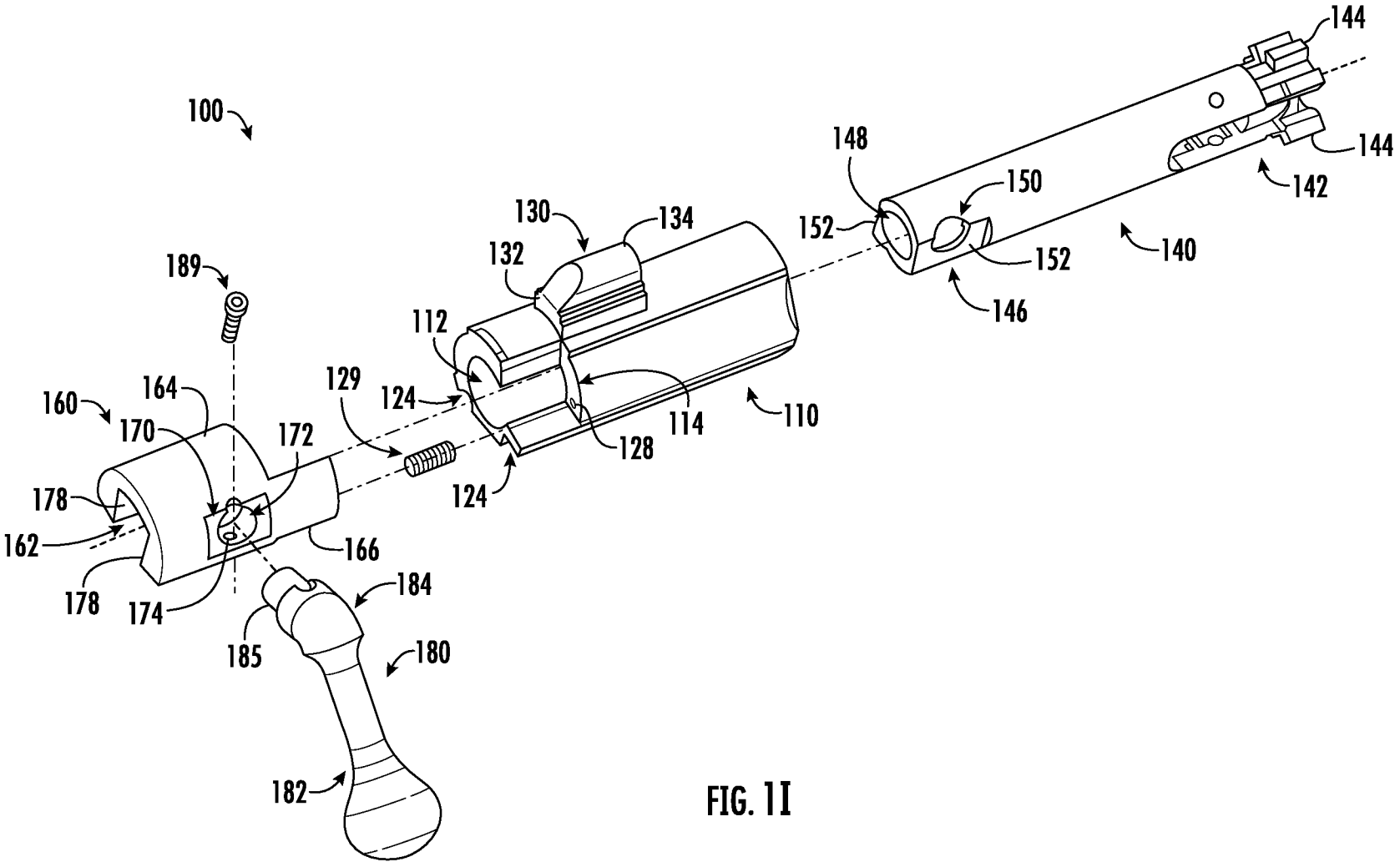
FIG. 1I is an exploded perspective view of the manual bolt assembly of FIG. 1A, showing the bolt carrier, the gas key, the bolt, the cam lock, the bolt handle, a ball-spring detent, and a fastener of the manual bolt assembly.

In the following description, specific details are set forth describing some examples consistent with the present disclosure. Numerous specific details are set forth in order to provide a thorough understanding of the examples. It will be apparent, however, to one skilled in the art that some examples may be practiced without some or all of these specific details. The specific examples disclosed herein are meant to be illustrative but not limiting. One skilled in the art may realize other examples that, although not specifically described here, are within the scope and the spirit of this disclosure. In addition, to avoid unnecessary repetition, one or more features shown and described in association with one example may be incorporated into other examples unless specifically described otherwise or if the one or more features would make an example non-functional. In some instances, well known methods, procedures, and components have not been described in detail so as not to unnecessarily obscure aspects of the examples.

The present disclosure provides manual bolt assemblies for a firearm, related assemblies for a firearm including a manual bolt assembly and a modified upper receiver, and related methods of manufacturing and using such manual bolt assemblies and related assemblies for a firearm. The manual bolt assemblies and related assemblies advantageously may allow an operator of a firearm, such as an AR pattern rifle, to change the action of the firearm from semi-automatic to manual bolt action. In some instances, the manual bolt assembly may be specifically configured for use with an AR pattern rifle, although other configurations of the manual bolt assembly for use with other types of firearms may be provided. Advantageously, the manual bolt assembly may be configured to operate and cooperate with all standard AR pattern parts other than an upper receiver that is modified, as compared to the standard AR pattern upper receiver, as described herein. In this manner, a standard AR pattern rifle may be modified to allow an operator to change the action of the rifle from semi-automatic to manual bolt action by implementing the disclosed manual bolt assembly and modified upper receiver.

As described above, certain firearms, such as AR pattern rifles, generally may be configured for semi-automatic operation and may lack means for manually actuating the bolt of the firearm. In some circumstances, it may be desirable to have an option to manually actuate the bolt of such firearms. For example, in some instances, manual actuation of the bolt may allow an operator to be more accurate when shooting the firearm. In other instances, firearm regulations in some jurisdictions may prohibit semi-automatic operation of certain firearms, thereby preventing use of such firearms without means for manually actuating the bolt of the firearm. As described herein, the manual bolt assembly and modified upper receiver may overcome one or more of these drawbacks associated with existing bolt assemblies and firearms, allowing the operator to change the action of the rifle from semi-automatic to manual bolt action, when desired.

The present disclosure provides manual bolt assemblies for a firearm, related assemblies for a firearm including a manual bolt assembly and an upper receiver, and related methods of manufacturing and using such manual bolt assemblies and assemblies. As disclosed, a manual bolt assembly may include a bolt carrier, a bolt, a cam lock, and a bolt handle. The bolt carrier may include a first central passage extending from a proximal end to a distal end of the bolt carrier, and a cutout defined along a side of the bolt carrier. The bolt may extend through the first central passage and may include a second central passage extending from a proximal end of the bolt, and a first aperture extending through a wall of the bolt to the second central passage. The cam lock may engage the bolt carrier and may include an arm movably disposed within the cutout, a third central passage extending from a proximal end of the cam lock, and a second aperture extending through a wall of the cam lock to the third central passage. The bolt handle may be coupled to the cam lock and may include a lever extending away from the cam lock, and a protrusion extending through the second aperture and through the first aperture. As disclosed, an upper receiver for use with the manual bolt assembly may include a slot defined in a lateral side of the upper receiver, and the bolt handle may extend through the slot of the upper receiver.

In some examples, the cam lock and the bolt may be configured to rotate relative to bolt carrier upon rotation of the bolt handle relative to the bolt carrier. In some examples, the arm of the cam lock may be configured to move within the cutout of the bolt carrier when the cam lock rotates relative to the bolt carrier. In some examples, the cam lock may be configured to translate rearward relative to the bolt carrier when the cam lock rotates relative to the bolt carrier. In some examples, the bolt carrier may include a cam ramp disposed adjacent to the cutout and configured to cause the cam lock to translate rearward relative to the bolt carrier when the cam lock rotates relative to the bolt carrier. In some examples, the first aperture may include an elongated slot configured such that the bolt does not translate relative to the bolt carrier when the cam lock translates rearward relative to the bolt carrier. In some examples, the cam lock may be configured to translate rearward relative to the bolt carrier from a first position to a second position, and the protrusion of the bolt handle may be configured to allow a firing pin of the firearm to translate forward toward the bolt when the cam lock is in the first position and to block the firing pin from translating forward toward the bolt when the cam lock is in the second position. In some examples, the cam lock may be configured to rotate relative to the bolt carrier from a first rotational position to a second rotational position, the bolt carrier may include a notch disposed adjacent the cutout, and the cam lock may include a protrusion configured to engage the notch when the cam lock is in the first position and to disengage the notch as the cam lock rotates from the first position to the second position. In some examples, the bolt may include a pair of first planar surfaces, and the cam lock may include a pair of second planar surfaces engaging the first planar surfaces such that the bolt rotates with the cam lock upon rotation of the bolt handle relative to the bolt carrier. In some examples, the bolt handle may be removably coupled to the cam lock by a fastener extending through the bolt handle and engaging a bore of the cam lock.

Various benefits and advantages of the manual bolt assemblies, related assemblies, and related methods provided herein over conventional devices and techniques will be appreciated by those of ordinary skill in the art from the present disclosure.

Example Manual Bolt Assemblies

Figure 1J:
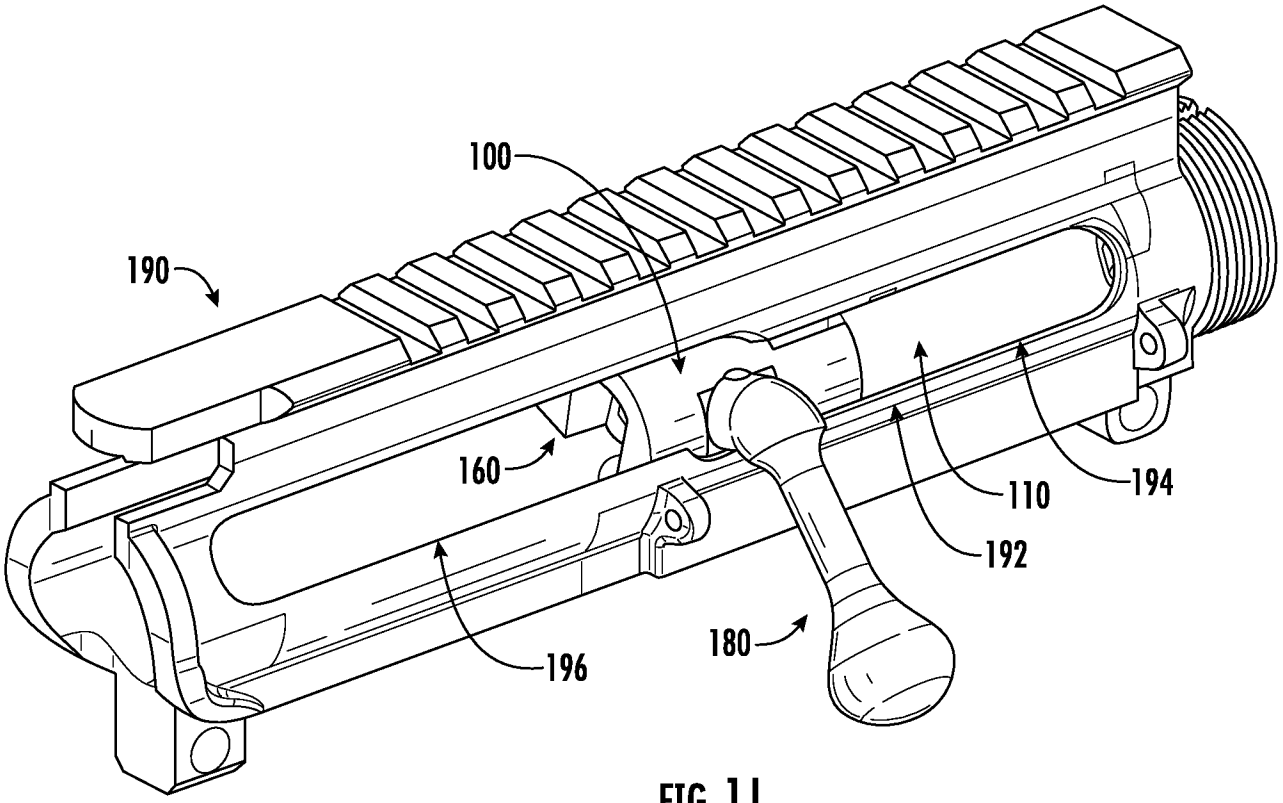
FIG. 1J is a perspective view of the manual bolt assembly of FIG. 1A assembled with a modified upper receiver for a firearm, according to one or more examples of the disclosure.

Referring now to the drawings, FIGS. 1A-1I illustrate a manual bolt assembly 100 according to one or more examples of the present disclosure, while FIG. 1J shows the manual bolt assembly 100 assembled for use with an upper receiver 190. According to the illustrated example, the manual bolt assembly 100 may be configured for use with an AR pattern rifle, although other configurations of the manual bolt assembly 100 for use with other types of firearms may be provided in other examples. The manual bolt assembly 100 may have a proximal end 101 and a distal end 102 disposed opposite one another along a longitudinal axis A of the manual bolt assembly 100. According to the illustrated example, the manual bolt assembly 100 may include a bolt carrier 110, a gas key 130, a bolt 140, a cam lock 160, and a bolt handle 180. Additional components of the manual bolt assembly 100 may be provided in other examples.

The bolt carrier 110 may be formed as an elongate, generally tubular structure having a proximal end and a distal end disposed opposite one another along a longitudinal axis of the bolt carrier 110. As shown, the bolt carrier 110 may include central passage 112 extending from the proximal end to the distal end of the bolt carrier 110 and configured to receive the bolt 140 therethrough. The bolt carrier 110 also may include a cutout 114 defined along a side of the bolt carrier 110, with the cutout 114 extending from the proximal end toward the distal end of the bolt carrier 110 and from an external surface of the bolt carrier 110 to the central passage 112. As described below, the cutout 114 may be configured to receive a mating portion of the cam lock 160 therein. As shown, the bolt carrier 110 may include a pair of channels 124 and a ramped surface 126 defined along the bottom of the bolt carrier 110. The channels 124 may be configured to cooperate with a magazine of the firearm as the bolt carrier 110 moves relative to the upper receiver 190, such that the bolt carrier 110 facilitates removal of a fresh cartridge from the magazine during cycling of the action. The ramped surface 126 may be configured to cooperate with a hammer of the firearm as the bolt carrier 110 moves relative to the upper receiver 190, such that the bolt carrier 110 facilitates cocking of the hammer during cycling of the action. As shown, the bolt carrier 110 may include a recess 128 disposed adjacent the cutout 114 and configured to selectively receive a mating portion of a ball-spring detent 129 coupled to the cam lock 160, as described further below. Additional features and functionality of the bolt carrier 110 will be appreciated by one skilled in the art from the drawings and the present description.

The gas key 130 may be formed as an elongate tubular structure disposed along the top of the bolt carrier 110. According to the illustrated example, the gas key 130 may be integrally formed with the bolt carrier 110 as a single component. In other examples, the gas key 130 and the bolt carrier 110 may be formed as separate components and fixedly coupled to one another. As shown, the gas key 130 may include a base 132 and a protrusion 134 extending upward from the base 132. The gas key 130 may include a gas port extending internally through the base 132 and the protrusion 134 and in communication with a gas port of the bolt carrier 110 and a gas tube extending between the gas key 130 and a gas block of the firearm. In this manner, the gas key 130 may receive and direct high-pressure gas expelled from a cartridge discharged using the firearm. The gas key 130 also may guide movement of the bolt carrier 110 relative to the upper receiver 190, as the protrusion 134 thereof may be movably received within an internal groove of the upper receiver 190, thereby guiding translation of the bolt carrier 110 relative to the upper receiver 190.

The bolt 140 may extend through the central passage 112 of the bolt carrier 110 and may be formed as an elongate, generally tubular structure having a proximal end and a distal end disposed opposite one another along a longitudinal axis of the bolt 140. The bolt 140 may include a distal portion 142 and a proximal portion 146. As shown, the distal portion 142 may be configured in a manner similar to the distal portion of a standard AR pattern bolt. In this manner, the distal portion 142 of the bolt 140 may be configured to operate and cooperate with a standard AR pattern barrel and related components. As shown, the distal portion 142 may include a plurality of lugs 144, in particular seven (7) of the lugs 144, with adjacent lugs 144 being circumferentially spaced apart from one another by forty-five (45) degrees. In contrast, the proximal portion 146 of the bolt 140 may differ from the proximal portion of a standard AR pattern bolt. As shown, the proximal portion 146 may include a central passage 148 extending from the proximal end of the bolt 140, and an aperture 150 extending through a wall of the bolt 140 to the central passage 148. As described below, the aperture 150 may be configured to receive a mating portion of the bolt handle 180 therethrough. The proximal portion 146 of the bolt 140 also may include a pair of planar surfaces 152 disposed opposite one another and configured to engage mating planar surfaces of the cam lock 160, as described below. As shown, the aperture 150 may extend through a portion of one of the planar surfaces 152. Additional features and functionality of the bolt 140 will be appreciated by one skilled in the art from the drawings and the present description.

The cam lock 160 may engage the bolt carrier 110 and may be formed as an elongate structure having a proximal end and a distal end disposed opposite one another along a longitudinal axis of the cam lock 160. As shown, the cam lock 160 may have an inverted, generally U-shaped profile when viewed from the proximal end or the distal end of the cam lock 160. The cam lock 160 may include a central passage 162 extending from the proximal end to the distal end of the cam lock 160 and configured to receive part of the proximal portion 146 of the bolt 140 therein. As shown, the cam lock 160 may include a base 164 and an arm 166 extending distally from the base 164. The arm 166 may be movably disposed within the cutout 114 of the bolt carrier 110 and configured to rotate relative to the bolt carrier 110. In particular, as the cam lock 160 rotates relative to the bolt carrier 110, the arm 166 may rotate within the cutout 114 from a first position to a second position. In some examples, the ball-spring detent 129 may be coupled to the cam lock 160 and configured to engage the recess 128 of the bolt carrier 110 when the arm 166 is in the first position and to disengage the recess 128 when the arm 166 is rotated away from the first position. In this manner, the engagement between the ball-spring detent 129 and the recess 128 may provide tactile feedback to an operator, indicating when the arm 166 is in the first position. In some examples, the ball-spring detent 129 may be coupled to the cam lock 160 and disposed within a mating bore defined in the arm 166. As shown, the cam lock 160 may include a recess 170, an aperture 172, and a bore 174 defined along a lateral side of the cam lock 160. The aperture 172 may extend through a wall of the cam lock 160 to the central passage 162 and be configured to receive a mating portion of the bolt handle 180 therein, as described below. As shown, the cam lock 160 may include a pair of planar surfaces 178 each partially defining the central passage 162 and configured to engage one of the planar surfaces 152 of the bolt 140. In this manner, due to the engagement of the planar surfaces 178 and the planar surfaces 152, rotation of the cam lock 160 relative to the bolt carrier 110 may cause the bolt 140 to rotate relative to the bolt carrier 110 as well. Additional features and functionality of the cam lock 160 will be appreciated by one skilled in the art from the drawings and the present description.

The bolt handle 180 may be coupled to the cam lock 160 and may be formed as an elongate structure having an inner end and an outer end disposed opposite one another along a longitudinal axis of the bolt handle 180. As shown, the bolt handle 180 may include a lever 182 and a knuckle 184 coupled to one another. According to the illustrated example, the lever 182 and the knuckle 184 may be integrally formed with one another as a single component. In other examples, the lever 182 and the knuckle 184 may be formed as separate components and fixedly coupled to one another. As shown, the bolt handle 180 may include a protrusion 185 disposed at the inner end of the bolt handle 180 and configured to extend through the aperture 172 of the cam lock 160 and the aperture 150 of the bolt 140. The protrusion 185 and the aperture 172 of the cam lock 160 may be configured and sized to provide a tight fit therebetween. As shown, the bolt handle 180 may be coupled to the cam lock 160 by a fastener 189 extending through a fastener bore 188 of the bolt handle 180 and into the bore 174 of the cam lock 160. The fastener 189 may be a threaded fastener, such as a socket head screw, as shown. In this manner, the bolt handle 180 may be removably coupled to the cam lock 160 by the fastener 189, allowing the bolt handle 180 to be removed from the cam lock 160 to facilitate disassembly of the manual bolt assembly 100 and removal from the upper receiver 190, when desired. Additional features and functionality of the bolt handle 180 will be appreciated by one skilled in the art from the drawings and the present description.

As shown in FIG. 1J, the upper receiver 190 may include a slot 192 defined in a lateral side of the upper receiver 190 and extending in a direction from the proximal end toward the distal end of the upper receiver 190. When the manual bolt assembly 100 is assembled for use with the upper receiver 190, the bolt handle 180 may extend through the slot 192, as shown. The slot 192 may include a distal portion 194 and a proximal portion 196 that is circumferentially offset from the distal portion 194 by twenty-two and a half (22.5) degrees. The slot 192 may be configured to facilitate manual actuation of the manual bolt assembly 100 via the bolt handle 180. With the manual bolt assembly 100 in the forward position shown in FIG. 1J, the operator may grasp the lever 182 and rotate the bolt handle 180 upward by twenty-two and a half (22.5) degrees into distal end of the proximal portion 196 of the slot 192. Due to the bolt handle 180 being coupled to the cam lock 160 via the protrusion 185 received within the aperture 172, such rotation of the bolt handle 180 may similarly rotate the cam lock 160 relative to the bolt carrier 110 by twenty-two and a half (22.5) degrees, thereby moving the arm 166 of the cam lock 160 within the cutout 114 of the bolt carrier 110. Further, due to the bolt handle 180 being engaged with the bolt 140 via the protrusion 185 received within the aperture 150, such rotation of the bolt handle 180 may similarly rotate the bolt 140 relative to the bolt carrier 110 by twenty-two and a half (22.5) degrees, thereby rotating the lugs 144 of the bolt 140 out of alignment. After rotating the bolt handle 180 in this manner, the operator may pull the bolt handle 180 rearward toward the proximal end of the proximal portion 196 of the slot 192, causing the bolt carrier 110 and the bolt 140 to similarly move rearward and a spent cartridge to be expelled through the distal portion 194 of the slot 192. The operator then may advance the bolt handle 180 forward to the distal end of the proximal portion 196 of the slot 192, thereby removing a fresh cartridge from the magazine, and rotating the bolt handle 180 downward by twenty-two and a half (22.5) degrees to enable the fresh cartridge to be discharged using the firearm. In this manner, the manual bolt assembly 100 may be used for manual operation of the action of the firearm.

Figure 2B:
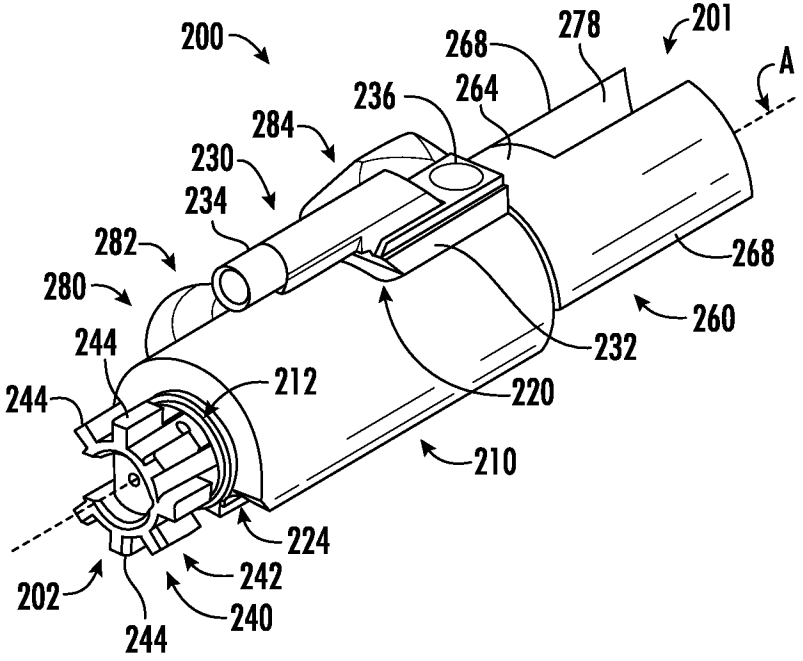
FIG. 2B is another perspective view of the manual bolt assembly of FIG. 2A.
Figure 2A:
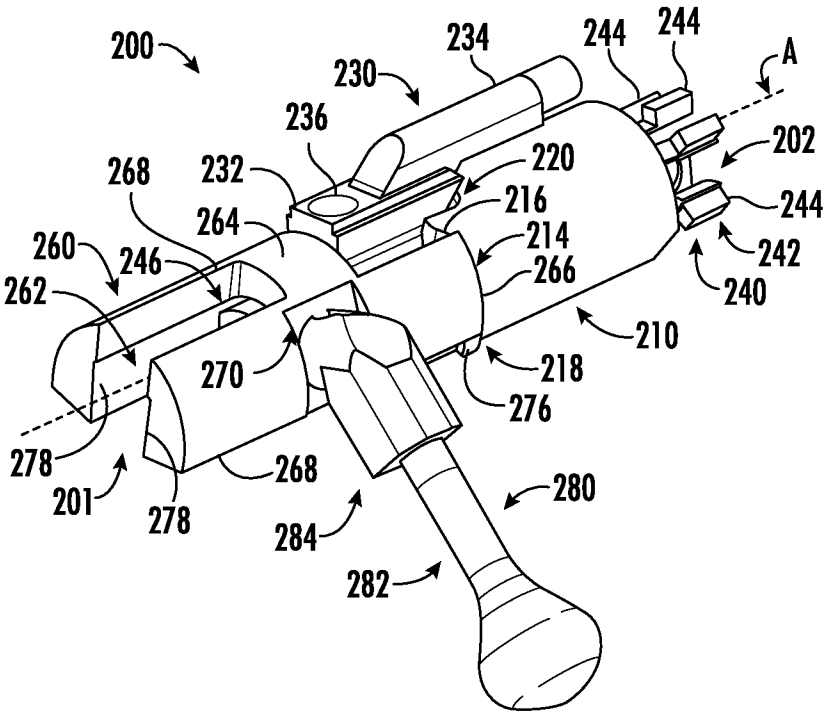
FIG. 2A is a perspective view of a manual bolt assembly for a firearm, according to one or more examples of the disclosure, showing a bolt carrier, a gas key, a bolt, a cam lock, and a bolt handle of the manual bolt assembly.
Figure 2D:
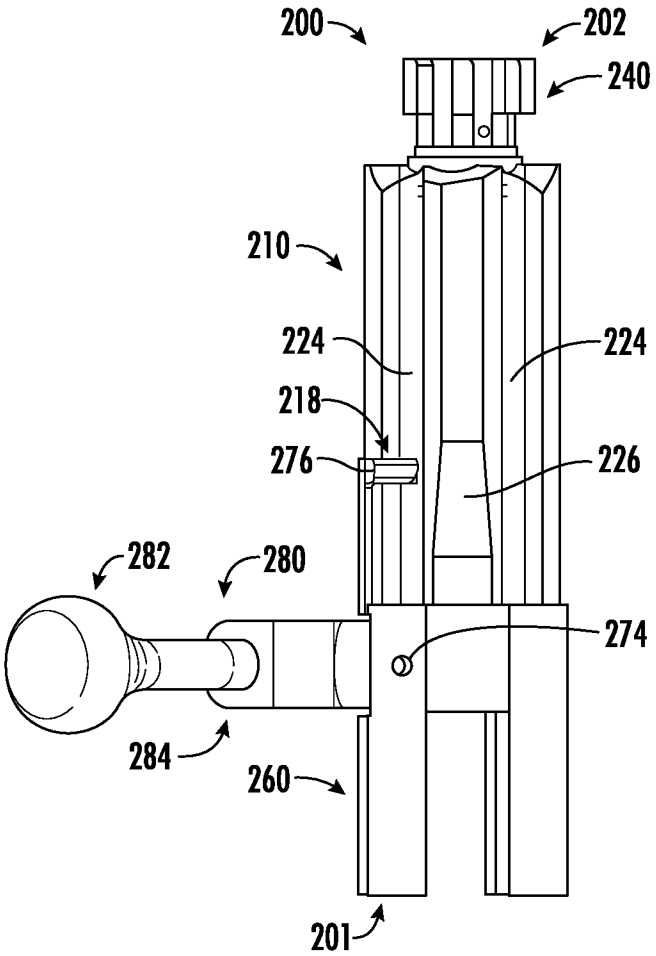
FIG. 2D is a bottom view of the manual bolt assembly of FIG. 2A.
Figure 2C:
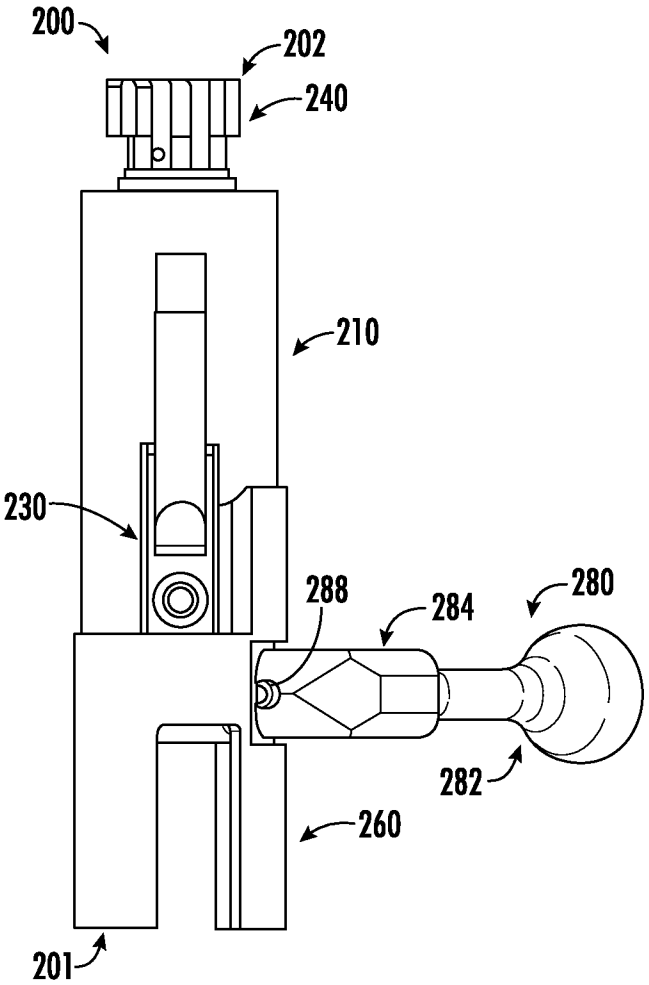
FIG. 2C is a top view of the manual bolt assembly of FIG. 2A.
Figure 2F:
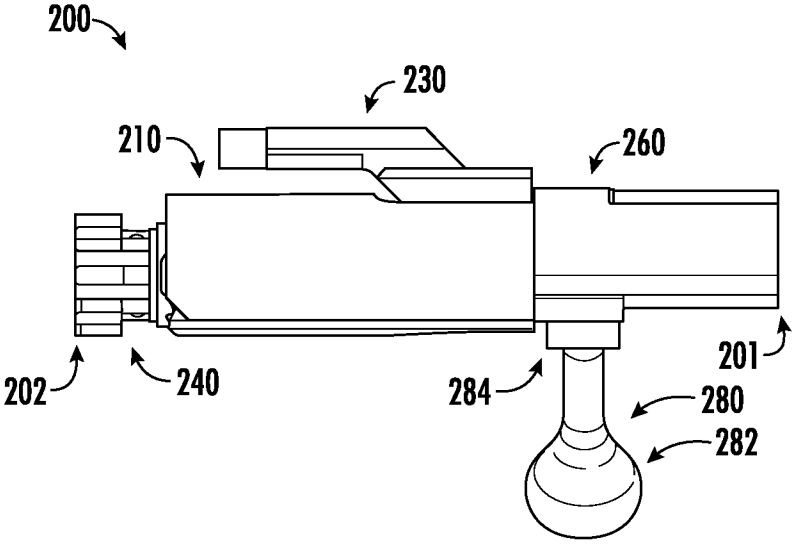
FIG. 2F is a left side view of the manual bolt assembly of FIG. 2A.
Figure 2E:
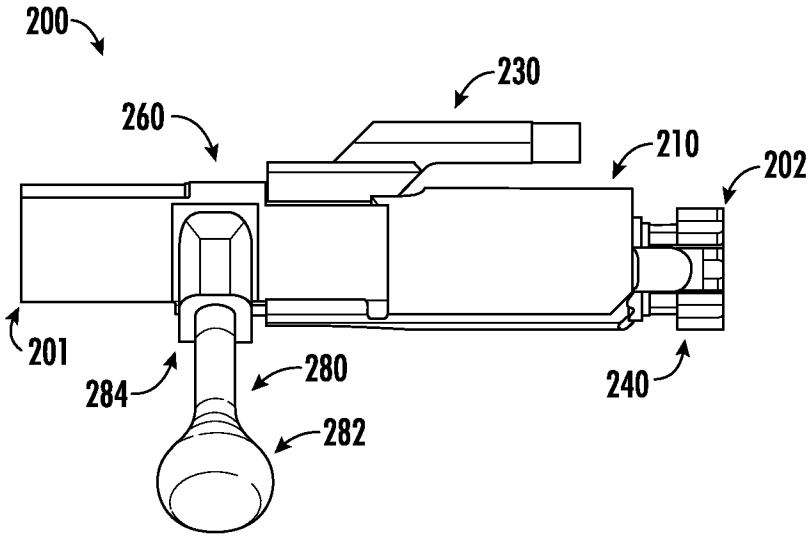
FIG. 2E is a right side view of the manual bolt assembly of FIG. 2A.
Figure 2H:
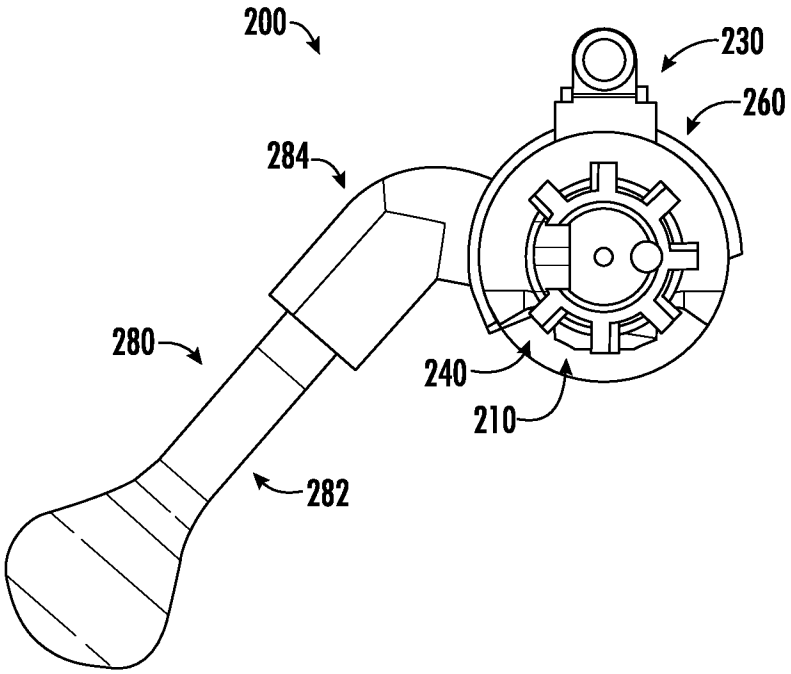
FIG. 2H is a distal end view of the manual bolt assembly of FIG. 2A.
Figure 2G:
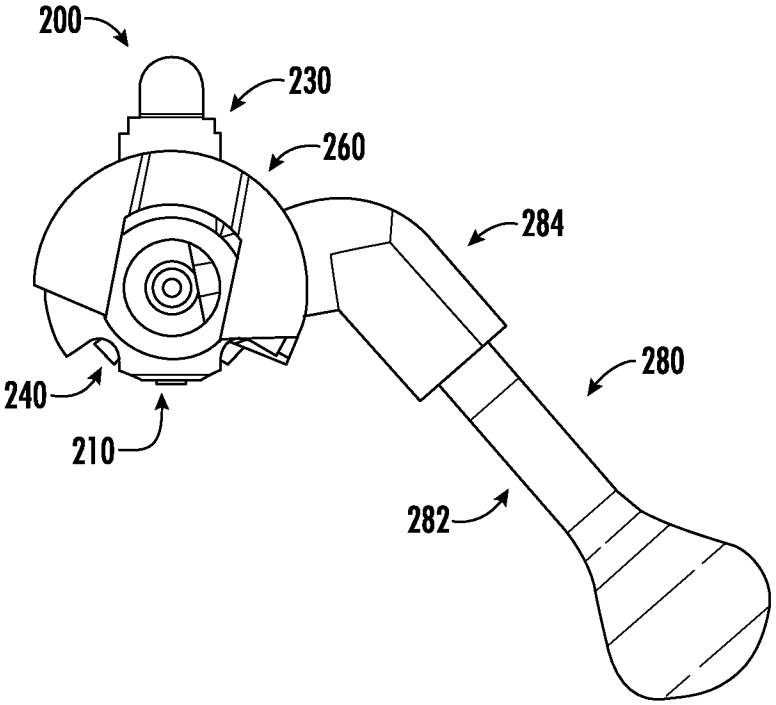
FIG. 2G is a proximal end view of the manual bolt assembly of FIG. 2A.
Figure 2I:
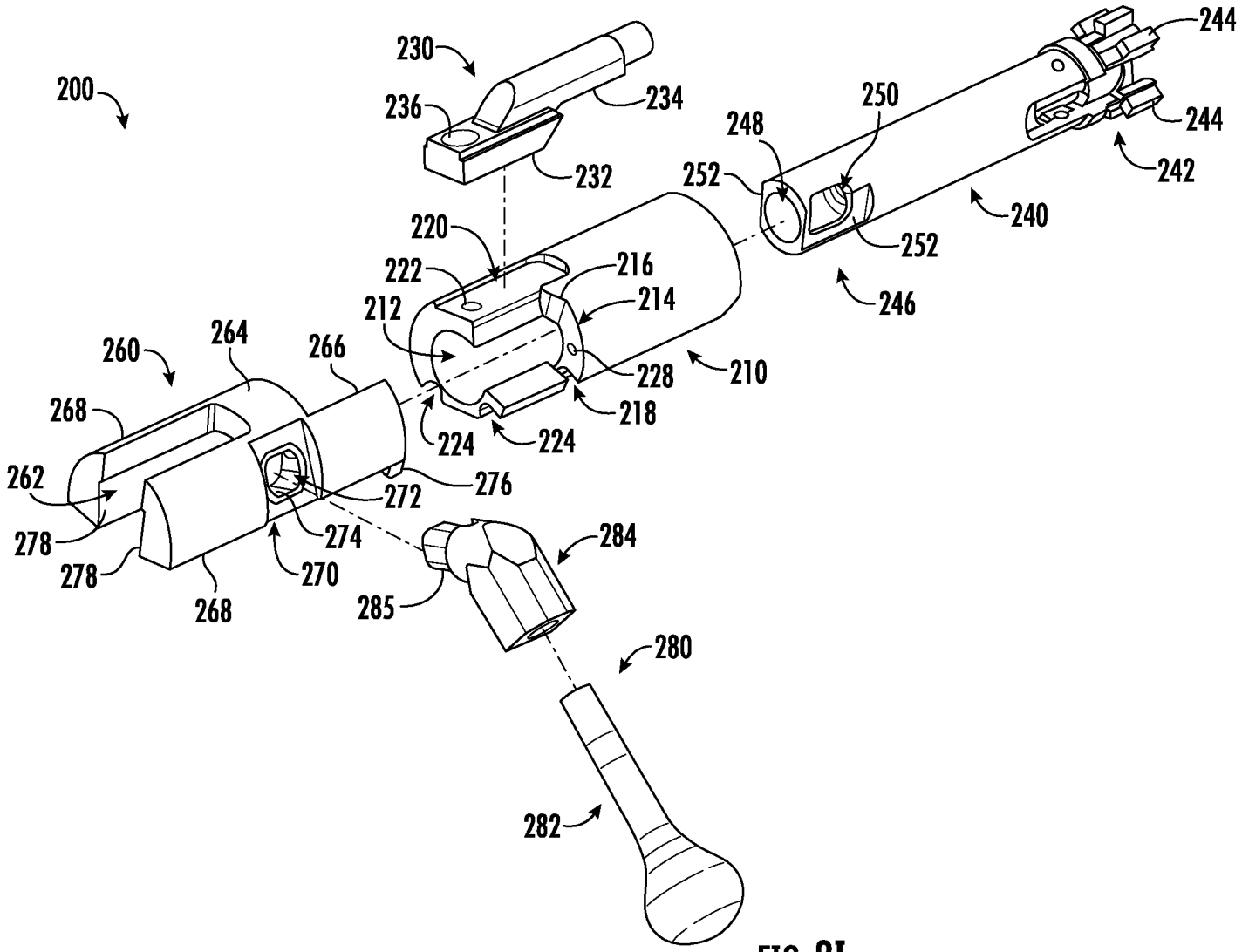
FIG. 2I is an exploded perspective view of the manual bolt assembly of FIG. 2A, showing the bolt carrier, the gas key, the bolt, the cam lock, and a lever and a knuckle of the bolt handle of the manual bolt assembly.
Figure 2K:
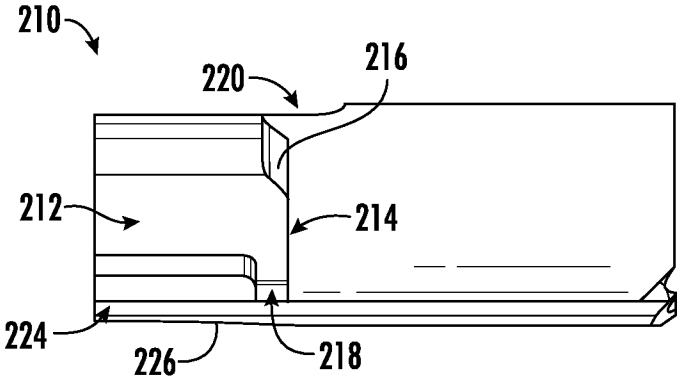
FIG. 2K is a right side view of the bolt carrier of the manual bolt assembly of FIG. 2A.
Figure 2M:
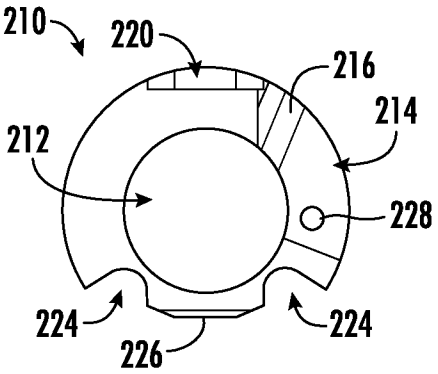
FIG. 2M is a proximal end view of the bolt carrier of the manual bolt assembly of FIG. 2A.
Figure 2J:
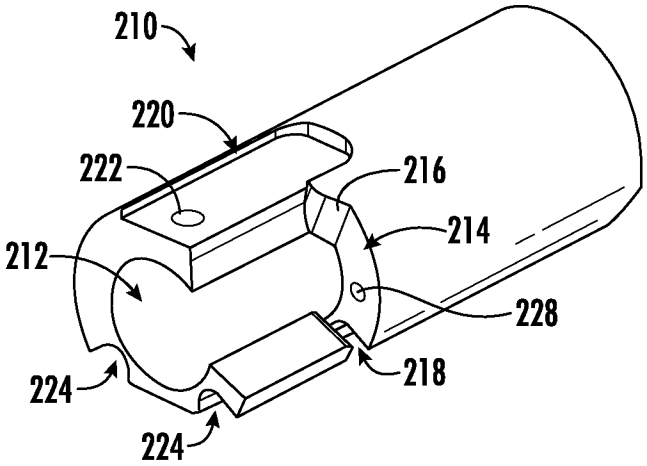
FIG. 2J is a perspective view of the bolt carrier of the manual bolt assembly of FIG. 2A.
Figure 2L:
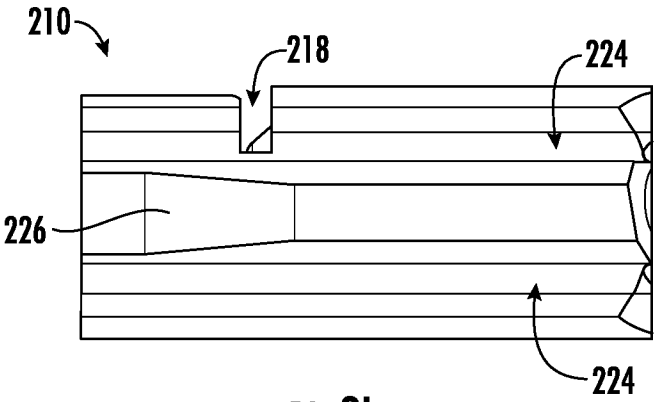
FIG. 2L is a bottom view of the bolt carrier of the manual bolt assembly of FIG. 2A.
Figure 2O:
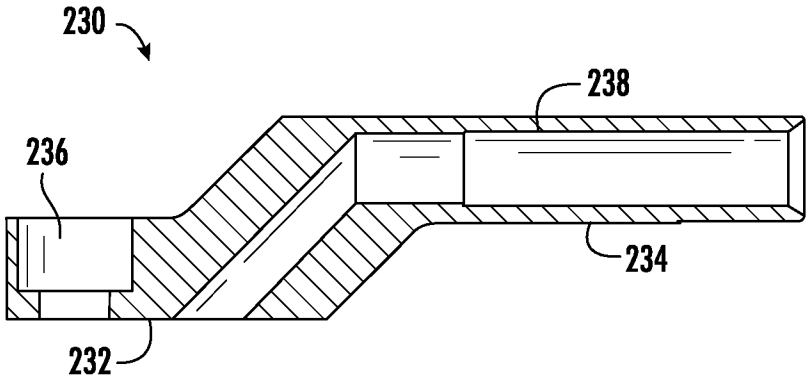
FIG. 2O is a cross-sectional right side view of the gas key of the manual bolt assembly of FIG. 2A.
Figure 2N:
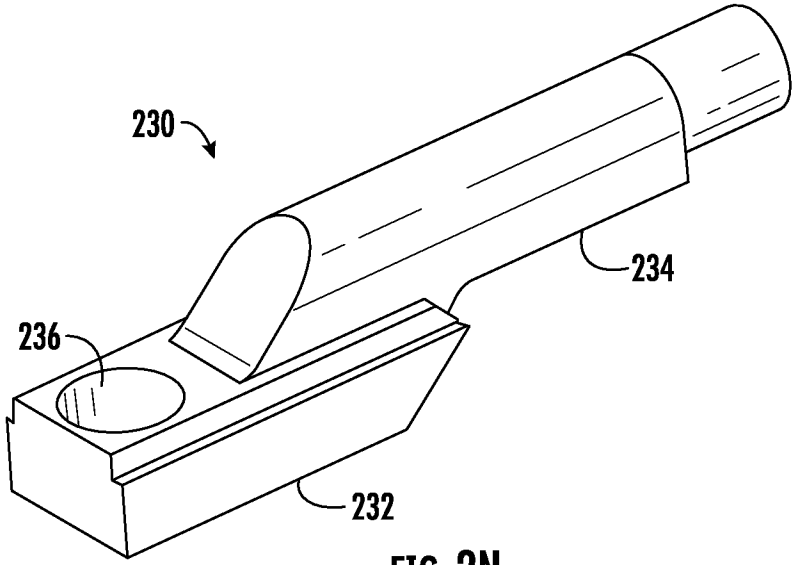
FIG. 2N is a perspective view of the gas key of the manual bolt assembly of FIG. 2A.
Figure 2Q:
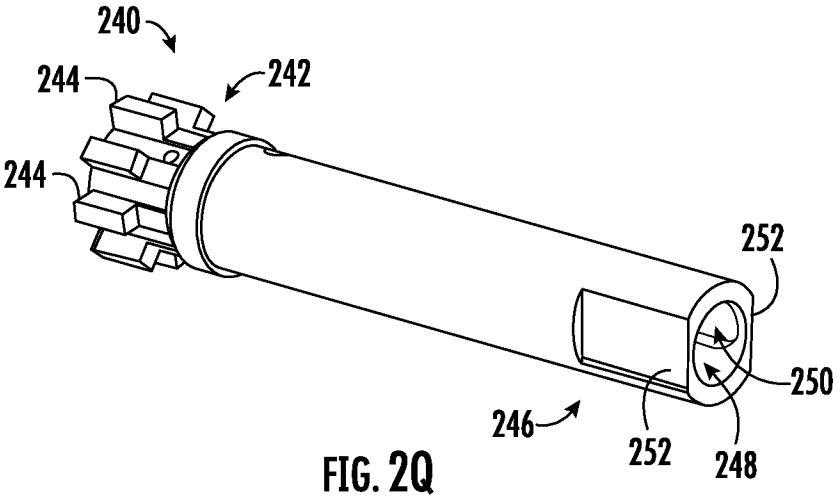
FIG. 2Q is another perspective view of the bolt of the manual bolt assembly of FIG. 2A.
Figure 2P:
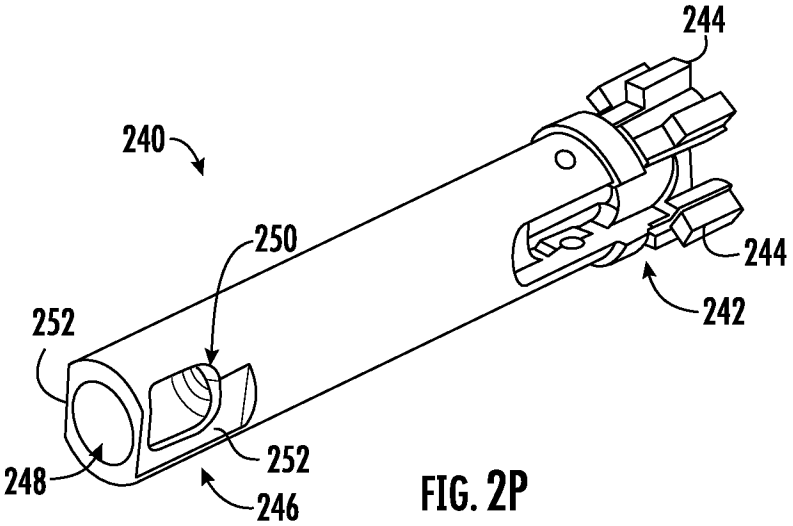
FIG. 2P is a perspective view of the bolt of the manual bolt assembly of FIG. 2A.
Figure 2S:
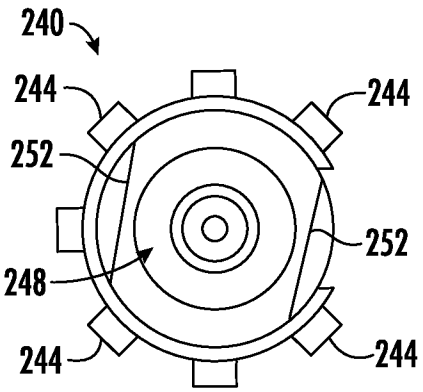
FIG. 2S is a proximal end view of the bolt of the manual bolt assembly of FIG. 2A.
Figure 2R:
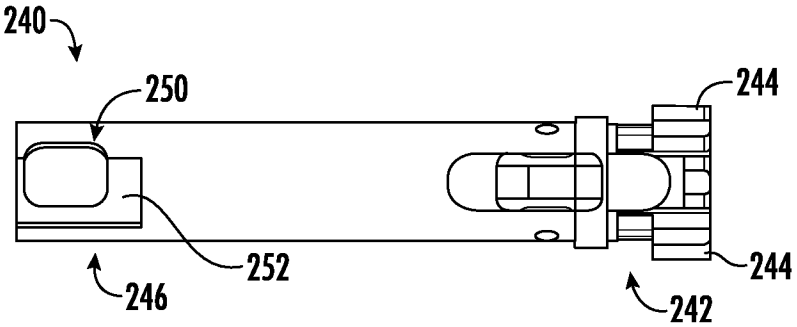
FIG. 2R is a bottom view of the bolt of the manual bolt assembly of FIG. 2A.
Figure 2U:
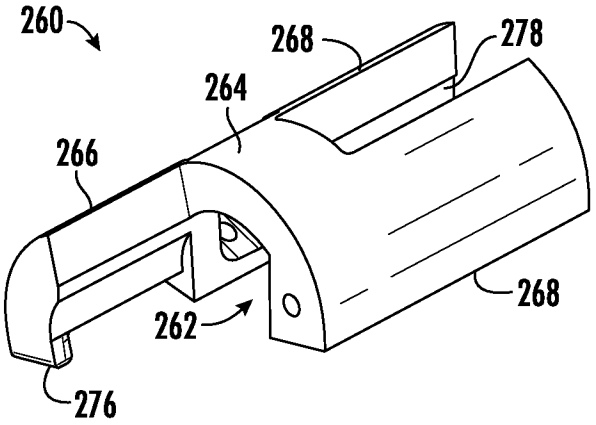
FIG. 2U is another perspective view of the cam lock of the manual bolt assembly of FIG. 2A.
Figure 2W:
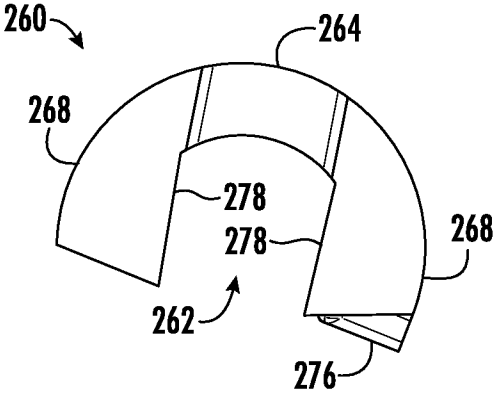
FIG. 2W is a proximal end view of the cam lock of the manual bolt assembly of FIG. 2A.
Figure 2T:
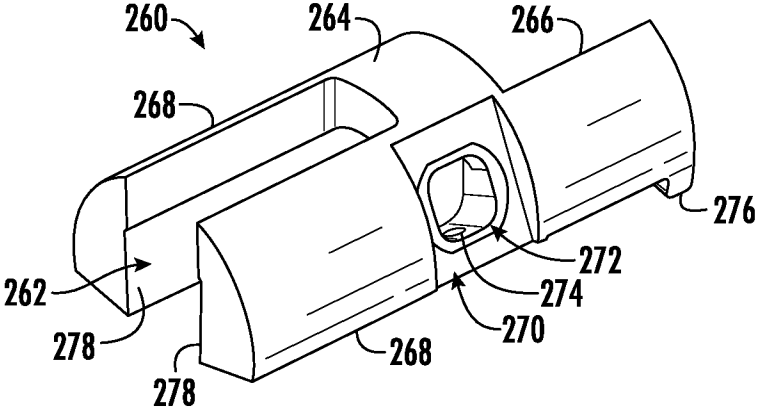
FIG. 2T is a perspective view of the cam lock of the manual bolt assembly of FIG. 2A.
Figure 2V:
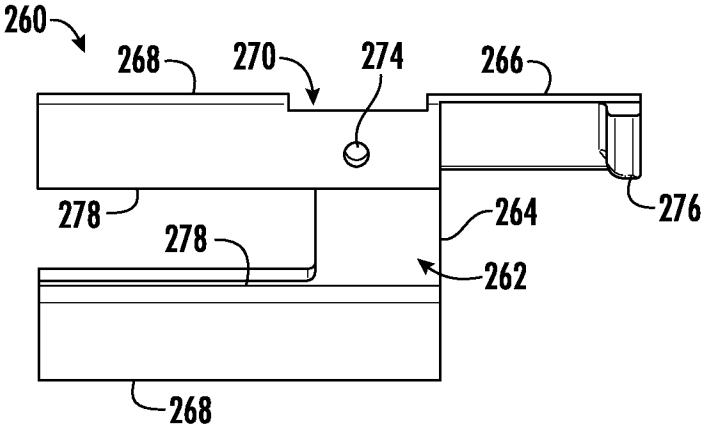
FIG. 2V is a bottom view of the cam lock of the manual bolt assembly of FIG. 2A.
Figure 2Y:
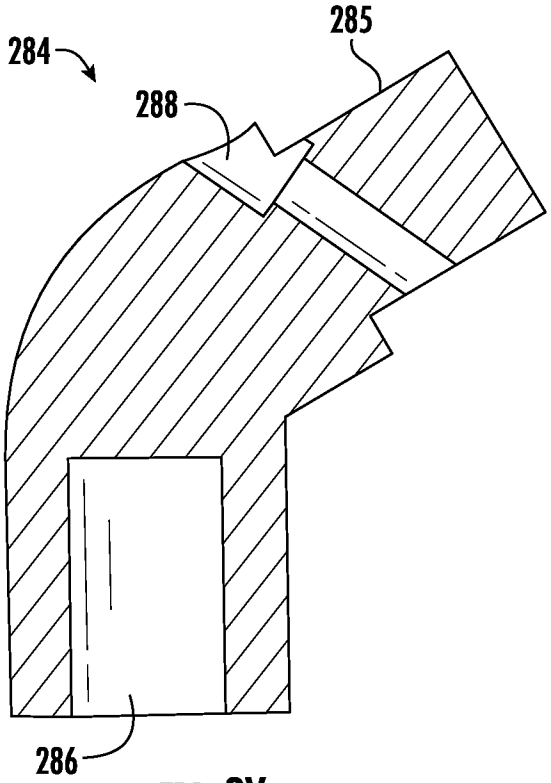
FIG. 2Y is a cross-sectional side view of the knuckle of the bolt handle of the manual bolt assembly of FIG. 2A.
Figure 2X:
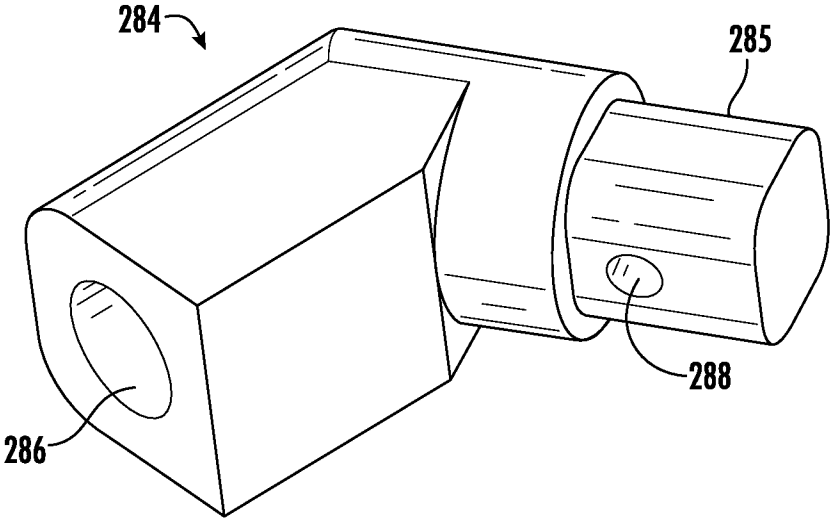
FIG. 2X is a perspective view of the knuckle of the bolt handle of the manual bolt assembly of FIG. 2A.

FIGS. 2A-2Y illustrate another manual bolt assembly 200 and components thereof according to one or more examples of the present disclosure. Certain similarities and differences between the manual bolt assembly 200 and the manual bolt assembly 100 described above will be appreciated from the drawings and the following description. The manual bolt assembly 200 may be used with the upper receiver 190 of FIG. 1J in a similar manner to that described above with respect to the manual bolt assembly 100. According to the illustrated example, the manual bolt assembly 200 may be configured for use with an AR pattern rifle, although other configurations of the manual bolt assembly 200 for use with other types of firearms may be provided in other examples. The manual bolt assembly 200 may have a proximal end 201 and a distal end 202 disposed opposite one another along a longitudinal axis A of the manual bolt assembly 200. According to the illustrated example, the manual bolt assembly 200 may include a bolt carrier 210, a gas key 230, a bolt 240, a cam lock 260, and a bolt handle 280. Additional components of the manual bolt assembly 200 may be provided in other examples.

The bolt carrier 210 may be formed as an elongate, generally tubular structure having a proximal end and a distal end disposed opposite one another along a longitudinal axis of the bolt carrier 210. As shown, the bolt carrier 210 may include central passage 212 extending from the proximal end to the distal end of the bolt carrier 210 and configured to receive the bolt 240 therethrough. The bolt carrier 210 also may include a cutout 214 defined along a side of the bolt carrier 210, with the cutout 214 extending from the proximal end toward the distal end of the bolt carrier 210 and from an external surface of the bolt carrier 210 to the central passage 212. As described below, the cutout 214 may be configured to receive a mating portion of the cam lock 260 therein. As shown, the bolt carrier 210 may include a cam ramp 216 disposed adjacent the cutout 214 and configured for guiding a mating feature of the cam lock 260 and causing the cam lock 260 to translate rearward relative to the bolt carrier 210 when the cam lock 260 is rotated relative to the bolt carrier 210, as described below. The bolt carrier 210 also may include a notch 218 disposed adjacent the cutout 214 and configured to selectively receive a mating feature of the cam lock 260, as described below. As shown, the bolt carrier 210 may include a recess 220 and a hole 222 defined along the top of the bolt carrier 210 and configured to cooperate with mating features of the gas key 230, as described below. As shown, the bolt carrier 210 may include a pair of channels 224 and a ramped surface 226 defined along the bottom of the bolt carrier 210. The channels 224 may be configured to cooperate with a magazine of the firearm as the bolt carrier 210 moves relative to the upper receiver 190, such that the bolt carrier 210 facilitates removal of a fresh cartridge from the magazine during cycling of the action. The ramped surface 226 may be configured to cooperate with a hammer of the firearm as the bolt carrier 210 moves relative to the upper receiver 190, such that the bolt carrier 210 facilitates cocking of the hammer during cycling of the action. As shown, the bolt carrier 210 may include a recess 228 disposed adjacent the cutout 214 and configured to selectively receive a mating portion of a ball-spring detent coupled to the cam lock 260, as described further below. Additional features and functionality of the bolt carrier 210 will be appreciated by one skilled in the art from the drawings and the present description.

The gas key 230 may be formed as an elongate tubular structure disposed along the top of the bolt carrier 210. According to the illustrated example, the gas key 230 and the bolt carrier 210 may be formed as separate components and fixedly coupled to one another by a fastener extending through the gas key 230 and engaging the hole 222 of the bolt carrier 210. In other examples, the gas key 230 may be integrally formed with the bolt carrier 210 as a single component. As shown, the gas key 230 may include a base 232 and a protrusion 234 extending upward and distally from the base 232, with an aperture 236 extending through the base 232 to accommodate the fastener coupling the gas key 230 to the bolt carrier 210. The gas key 230 may include a gas port 238 extending internally through the base 232 and the protrusion 234 and in communication with a gas port, when present, of the bolt carrier 210 and a gas tube extending between the gas key 230 and a gas block of the firearm. In this manner, the gas key 230 may receive and direct high-pressure gas expelled from a cartridge discharged using the firearm. The gas key 230 also may guide movement of the bolt carrier 210 relative to the upper receiver 190, as the protrusion 234 thereof may be movably received within an internal groove of the upper receiver 190, thereby guiding translation of the bolt carrier 210 relative to the upper receiver 190.

The bolt 240 may extend through the central passage 212 of the bolt carrier 210 and may be formed as an elongate, generally tubular structure having a proximal end and a distal end disposed opposite one another along a longitudinal axis of the bolt 240. The bolt 240 may include a distal portion 242 and a proximal portion 246. As shown, the distal portion 242 may be configured in a manner similar to the distal portion of a standard AR pattern bolt. In this manner, the distal portion 242 of the bolt 240 may be configured to operate and cooperate with a standard AR pattern barrel and related components. As shown, the distal portion 242 may include a plurality of lugs 244, in particular seven (7) of the lugs 244, with adjacent lugs 244 being circumferentially spaced apart from one another by forty-five (45) degrees. In contrast, the proximal portion 246 of the bolt 240 may differ from the proximal portion of a standard AR pattern bolt. As shown, the proximal portion 246 may include a central passage 248 extending from the proximal end of the bolt 240, and an aperture 250 extending through a wall of the bolt 240 to the central passage 248. As described below, the aperture 250 may be configured to receive a mating portion of the bolt handle 280 therethrough. In some examples, as shown, the aperture 250 may be formed as an elongated slot extending in the direction of the longitudinal axis of the bolt 240, allowing for a degree of translational movement of the bolt handle 280 relative to the bolt 240, as described below. The proximal portion 246 of the bolt 240 also may include a pair of planar surfaces 252 disposed opposite one another and configured to engage mating planar surfaces of the cam lock 260, as described below. As shown, the aperture 250 may extend through a portion of one of the planar surfaces 252. Additional features and functionality of the bolt 240 will be appreciated by one skilled in the art from the drawings and the present description.

The cam lock 260 may engage the bolt carrier 210 and may be formed as an elongate structure having a proximal end and a distal end disposed opposite one another along a longitudinal axis of the cam lock 260. As shown, the cam lock 260 may have an inverted, generally U-shaped profile when viewed from the proximal end or the distal end of the cam lock 260. The cam lock 260 may include a central passage 262 extending from the proximal end to the distal end of the cam lock 260 and configured to receive part of the proximal portion 246 of the bolt 240 therein. As shown, the cam lock 260 may include a base 264, an arm 266 extending distally from the base 264, and a pair of legs 268 extending proximally from the base 264. The arm 266 may be movably disposed within the cutout 214 of the bolt carrier 210 and configured to rotate relative to the bolt carrier 210. In particular, as the cam lock 260 rotates relative to the bolt carrier 210, the arm 266 may rotate within the cutout 214 from a first position to a second position. In some examples, a ball-spring detent (such as the fastener 229 described above) may be coupled to the cam lock 260 and configured to engage the recess 228 of the bolt carrier 210 when the arm 266 is in the first position and to disengage the recess 228 when the arm 266 is rotated away from the first position. In this manner, the engagement between the ball-spring detent and the recess 228 may provide tactile feedback to an operator, indicating when the arm 266 is in the first position. In some examples, the ball-spring detent may be coupled to the cam lock 260 and disposed within a mating bore defined in the arm 266. In some examples, as shown, the arm 266 may be configured to engage the cam ramp 216 of the bolt carrier 210 when the cam lock 260 is rotated relative to the bolt carrier 210, such that the cam ramp 216 causes the cam lock 260 to translate rearward relative to the bolt carrier 210. In some examples, as shown, the cam lock 260 may include a protrusion 276 disposed along the bottom of the arm 266 and configured to selectively engage the notch 218 of the bolt carrier 210 when the arm 266 is in the first position, thereby inhibiting inadvertent translation of the cam lock 260 relative to the bolt carrier 210 when the arm 266 is in the first position. As shown, the cam lock 260 may include a recess 270, an aperture 272, and a bore 274 defined along a lateral side of the cam lock 260. The aperture 272 may extend through a wall of the cam lock 260 to the central passage 262 and be configured to receive a mating portion of the bolt handle 280 therein, as described below. As shown, the cam lock 260 may include a pair of planar surfaces 278 each partially defining the central passage 262 and configured to engage one of the planar surfaces 252 of the bolt 240. In this manner, due to the engagement of the planar surfaces 278 and the planar surfaces 252, rotation of the cam lock 260 relative to the bolt carrier 210 may cause the bolt 240 to rotate relative to the bolt carrier 210 as well. Additional features and functionality of the cam lock 260 will be appreciated by one skilled in the art from the drawings and the present description.

The bolt handle 280 may be coupled to the cam lock 260 and may be formed as an elongate structure having an inner end and an outer end disposed opposite one another along a longitudinal axis of the bolt handle 280. As shown, the bolt handle 280 may include a lever 282 and a knuckle 284 coupled to one another. According to the illustrated example, the lever 282 and the knuckle 284 may be formed as separate components and fixedly coupled to one another, for example by inserting an end portion of the lever 282 into a bore 286 defined in the knuckle 284 and welding the components to one another. In other examples, the lever 282 and the knuckle 284 may be integrally formed with one another as a single component. As shown, the bolt handle 280 may include a protrusion 285 disposed at the inner end of the bolt handle 280 and configured to extend through the aperture 272 of the cam lock 260 and the aperture 250 of the bolt 240. The protrusion 285 and the aperture 272 of the cam lock 260 may be configured and sized to provide a tight fit therebetween. As shown, the bolt handle 280 may be coupled to the cam lock 260 by a fastener (such as the fastener 189 described above) extending through a fastener bore 288 of the bolt handle 280 and into the bore 274 of the cam lock 260. The fastener may be a threaded fastener, such as a socket head screw. In this manner, the bolt handle 280 may be removably coupled to the cam lock 260 by the fastener 289, allowing the bolt handle 280 to be removed from the cam lock 260 to facilitate disassembly of the manual bolt assembly 200 and removal from the upper receiver 190, when desired. Additional features and functionality of the bolt handle 280 will be appreciated by one skilled in the art from the drawings and the present description.

When the manual bolt assembly 200 is assembled for use with the upper receiver 190, the bolt handle 280 may extend through the slot 192 configured to facilitate manual actuation of the manual bolt assembly 200 via the bolt handle 280. With the manual bolt assembly 200 in the forward position, the operator may grasp the lever 282 and rotate the bolt handle 280 upward by twenty-two and a half (22.5) degrees into distal end of the proximal portion 196 of the slot 192. Due to the bolt handle 280 being coupled to the cam lock 260 via the protrusion 285 received within the aperture 272, such rotation of the bolt handle 280 may similarly rotate the cam lock 260 relative to the bolt carrier 210 by twenty-two and a half (22.5) degrees, thereby moving the arm 266 of the cam lock 260 within the cutout 214 of the bolt carrier 210. Further, due to the bolt handle 280 being engaged with the bolt 240 via the protrusion 285 received within the aperture 250, such rotation of the bolt handle 280 may similarly rotate the bolt 240 relative to the bolt carrier 210 by twenty-two and a half (22.5) degrees, thereby rotating the lugs 244 of the bolt 240 out of alignment. Additionally, due to the cam ramp 216 of the bolt carrier 210 engaging the arm 266 of the cam lock 260 during such rotation of the bolt handle 280, the cam lock 260 may translate rearward relative to the bolt carrier 210. Notably, due to the elongated slot configuration of the aperture 250 of the bolt 240, such translation of the cam lock 260 and the bolt handle 280 coupled thereto does not cause the bolt 240 to translate relative to the bolt carrier 210. In particular, the protrusion 285 and the aperture 250 may be configured and sized such that the protrusion 285 translates within the aperture 250, moving from the distal end of the aperture 250 to the proximal end of the aperture 250. The translation of the bolt handle 280 relative to the bolt carrier 210 advantageously may cause the protrusion 285 to block the firing pin of the firearm from advancing toward the bolt 240, thereby providing an enhanced safety feature upon the upward rotation of the bolt handle 280. After rotating the bolt handle 280 in this manner, the operator may pull the bolt handle 280 rearward toward the proximal end of the proximal portion 196 of the slot 192, causing the bolt carrier 210 and the bolt 240 to similarly move rearward and a spent cartridge to be expelled through the distal portion 194 of the slot 192. The operator then may advance the bolt handle 280 forward to the distal end of the proximal portion 196 of the slot 192, thereby removing a fresh cartridge from the magazine, and rotate the bolt handle 280 downward by twenty-two and a half (22.5) degrees to enable the fresh cartridge to be discharged using the firearm. In this manner, the manual bolt assembly 200 may be used for manual operation of the action of the firearm.

Although specific examples of the disclosure have been described, numerous other modifications and alternative examples are within the scope of the disclosure. For example, any of the functionalities described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

I claim:

1. A manual bolt assembly for a firearm, the manual bolt assembly comprising:

a bolt carrier comprising:

a first central passage extending from a proximal end to a distal end of the bolt carrier; and a cutout defined along a side of the bolt carrier;

a bolt extending through the first central passage, the bolt comprising:

a second central passage extending from a proximal end of the bolt; and a first aperture extending through a wall of the bolt to the second central passage;

a cam lock engaging the bolt carrier, the cam lock comprising:

an arm movably disposed within the cutout;

a third central passage extending from a proximal end of the cam lock; and a second aperture extending through a wall of the cam lock to the third central passage; and a bolt handle coupled to the cam lock, the bolt handle comprising:

a lever extending away from the cam lock; and a protrusion extending through the second aperture and through the first aperture.

2. The manual bolt assembly of claim 1, wherein the cam lock and the bolt are configured to rotate relative to bolt carrier upon rotation of the bolt handle relative to the bolt carrier.

3. The manual bolt assembly of claim 2, wherein the arm of the cam lock is configured to move within the cutout of the bolt carrier when the cam lock rotates relative to the bolt carrier.

4. The manual bolt assembly of claim 2, wherein the cam lock is configured to translate rearward relative to the bolt carrier when the cam lock rotates relative to the bolt carrier.

5. The manual bolt assembly of claim 4, wherein the bolt carrier comprises a cam ramp disposed adjacent the cutout and configured to cause the cam lock to translate rearward relative to the bolt carrier when the cam lock rotates relative to the bolt carrier.

6. The manual bolt assembly of claim 4, wherein the first aperture comprises an elongated slot configured such that the bolt does not translate relative to the bolt carrier when the cam lock translates rearward relative to the bolt carrier.

7. The manual bolt assembly of claim 4, wherein:

the cam lock is configured to translate rearward relative to the bolt carrier from a first position to a second position; and the protrusion of the bolt handle is configured to allow a firing pin of the firearm to translate forward toward the bolt when the cam lock is in the first position and to block the firing pin from translating forward toward the bolt when the cam lock is in the second position.

8. The manual bolt assembly of claim 3, wherein:

the cam lock is configured to rotate relative to the bolt carrier from a first rotational position to a second rotational position;

the bolt carrier comprises a notch disposed adjacent the cutout; and the cam lock comprises a protrusion configured to engage the notch when the cam lock is in the first position and to disengage the notch as the cam lock rotates from the first position to the second position.

9. The manual bolt assembly of claim 3, wherein:

the bolt comprises a pair of first planar surfaces; and the cam lock comprises a pair of second planar surfaces engaging the first planar surfaces such that the bolt rotates with the cam lock upon rotation of the bolt handle relative to the bolt carrier.

10. The manual bolt assembly of claim 1, wherein the bolt handle is removably coupled to the cam lock by a fastener extending through the bolt handle and engaging a bore of the cam lock.

11. An assembly for a firearm, the assembly comprising:

an upper receiver comprising a slot defined in a lateral side of the upper receiver; and a manual bolt assembly disposed partially within the upper receiver, the manual bolt assembly comprising:

a bolt carrier comprising:

a first central passage extending from a proximal end to a distal end of the bolt carrier; and a cutout defined along a side of the bolt carrier;

a bolt extending through the first central passage, the bolt comprising:

a second central passage extending from a proximal end of the bolt; and a first aperture extending through a wall of the bolt to the second central passage;

a cam lock engaging the bolt carrier, the cam lock comprising:

an arm movably disposed within the cutout;

a third central passage extending from a proximal end of the cam lock; and a second aperture extending through a wall of the cam lock to the third central passage; and a bolt handle coupled to the cam lock and extending through the slot of the upper receiver, the bolt handle comprising:

a lever extending away from the cam lock; and a protrusion extending through the second aperture and through the first aperture.

12. The assembly of claim 11, wherein the cam lock and the bolt are configured to rotate relative to bolt carrier upon rotation of the bolt handle relative to the bolt carrier.

13. The assembly of claim 12, wherein the arm of the cam lock is configured to move within the cutout of the bolt carrier when the cam lock rotates relative to the bolt carrier.

14. The assembly of claim 12, wherein the cam lock is configured to translate rearward relative to the bolt carrier when the cam lock rotates relative to the bolt carrier.

15. The assembly of claim 14, wherein the bolt carrier comprises a cam ramp disposed adjacent the cutout and configured to cause the cam lock to translate rearward relative to the bolt carrier when the cam lock rotates relative to the bolt carrier.

16. The assembly of claim 14, wherein the first aperture comprises an elongated slot configured such that the bolt does not translate relative to the bolt carrier when the cam lock translates rearward relative to the bolt carrier.

17. The assembly of claim 14, wherein:

the cam lock is configured to translate rearward relative to the bolt carrier from a first position to a second position; and the protrusion of the bolt handle is configured to allow a firing pin of the firearm to translate forward toward the bolt when the cam lock is in the first position and to block the firing pin from translating forward toward the bolt when the cam lock is in the second position.

18. The assembly of claim 13, wherein:

the cam lock is configured to rotate relative to the bolt carrier from a first rotational position to a second rotational position;

the bolt carrier comprises a notch disposed adjacent the cutout; and the cam lock comprises a protrusion configured to engage the notch when the cam lock is in the first position and to disengage the notch as the cam lock rotates from the first position to the second position.

19. The assembly of claim 13, wherein:

the bolt comprises a pair of first planar surfaces; and the cam lock comprises a pair of second planar surfaces engaging the first planar surfaces such that the bolt rotates with the cam lock upon rotation of the bolt handle relative to the bolt carrier.

20. The assembly of claim 11, wherein the bolt handle is removably coupled to the cam lock by a fastener extending through the bolt handle and engaging a bore of the cam lock.

* * * * *